US005622148A

United States Patent [19]

Xue et al.

[11] Patent Number: 5,622,148

[45] Date of Patent: Apr. 22, 1997

[54] CONTROL FOR A MOTOR VEHICLE CRANKING SYSTEM

[75] Inventors: Xiaolin B. Xue, Novi; Charles M. Freitas, Chelsea; Mark A. Brantmeyer, Ypsilanti; Xingyi Xu, Canton; John G. Bulick, Dexter, all of Mich.

[73] Assignee: Ford Motor Company, Dearborn, Mich.

[21] Appl. No.: 567,014

[22] Filed: Dec. 4, 1995

[51] Int. Cl.[6] ..... F02N 11/08

[52] U.S. Cl. ..... 123/179.25; 290/38 R

[58] Field of Search ..... 123/179.3, 179.25, 123/179.1; 290/38 R, 38 C

[56] References Cited

U.S. PATENT DOCUMENTS

| | | | |
|---|---|---|---|
| 4,862,010 | 8/1989 | Yamamoto | 290/38 R |
| 4,896,637 | 1/1990 | Yamamoto | 123/179.3 |
| 4,917,410 | 4/1990 | Cummins et al. | 290/38 R |
| 5,325,827 | 7/1994 | Fasola | 123/179.3 |
| 5,343,351 | 8/1994 | Quantz | 361/33 |
| 5,345,901 | 9/1994 | Siegenthaler et al. | 123/179.3 |
| 5,347,419 | 9/1994 | Caron et al. | 361/154 |
| 5,377,068 | 12/1994 | Kaylor et al. | 361/154 |
| 5,381,297 | 1/1995 | Weber | 361/153 |
| 5,383,428 | 1/1995 | Fasola et al. | 123/179.3 |
| 5,402,758 | 4/1995 | Land et al. | 23/179.3 |

*Primary Examiner*—Andrew M. Dolinar
*Attorney, Agent, or Firm*—Mark S. Sparschu

[57] ABSTRACT

In one embodiment of the present invention, a cranking system for a motor vehicle engine includes a starter motor assembly having a cranking motor and a starter solenoid. An electronic controller independently controls actuation of the starter solenoid and a contactor which provides current to the cranking motor. In this embodiment of the invention, the starter solenoid has a single electrical coil. Further, the contactor is relocated from its typical location within the starter solenoid to within the electronic controller, located remotely from the starter motor assembly.

18 Claims, 5 Drawing Sheets

CONTROL FOR A MOTOR VEHICLE CRANKING SYSTEM

BACKGROUND OF THE INVENTION

1. Field of the Invention

The present invention relates to cranking systems for motor vehicle engines.

2. Description of the Related Art

A conventional starter motor assembly 20 for a motor vehicle engine is illustrated in FIG. 6. Starter motor assembly 20 includes cranking motor 22 and starter solenoid 24. Cranking motor 22 includes drive assembly 26 which typically includes an overrunning clutch and which further includes pinion gear 28. Drive assembly 26 is translatably mounted on shaft 30 such that when translated to the right as viewed in FIG. 6, pinion gear 28 can mesh with a ring gear 32 on the engine. When pinion gear 28 and ring gear 32 are so meshed, cranking motor 22 can crank the engine.

Starter solenoid 24 includes two electrical coils, pull-in coil 34 and hold-in coil 36. Pull-in coil 34 and hold-in coil 36 are electromagnetically coupled to plunger assembly 38. The movement of plunger assembly 38 to the left as viewed in FIG. 6 during actuation of starter solenoid 24 has two effects. One, plunger assembly 38 pulls on lever 40, translating drive assembly 26 to the right such that pinion gear 28 can mesh with ring gear 32. Two, movable contact 42 electrically couples fixed contacts 44 and 46. Through this coupling, battery power is provided to cranking motor 22 for cranking the engine.

Electrically, a cranking system which employs starter motor assembly 20 is illustrated with additional reference to FIG. 7. Battery 48 provides electrical power for cranking motor 22 and starter solenoid 24. When ignition switch 50 is closed, pull-in coil 34 is energized via the armature winding of cranking motor 22. Hold-in coil 36 is also energized. Plunger assembly 38 is thus drawn to the left as viewed in FIGS. 6 and 7.

While solenoid 24 is being actuated, two alternative scenarios can occur. In one, the teeth of pinion gear 28 might be offset from the teeth of ring gear 32, allowing meshing of those two gears. In that case, the gears mesh and movable contact 42 electrically couples fixed contacts 44 and 46. This both shorts pull-in coil 34 (leaving hold-in coil 36 to hold engagement of pinion gear 28 with ring gear 32) and provides electrical power to cranking motor 22 to crank the engine.

In the second alternative scenario, the teeth of pinion gear 28 may be aligned with the teeth of ring gear 32, preventing meshing of those two gears and movement of movable contact 42 into contact with fixed contacts 44 and 46. In that event, mesh spring 49 compresses, allowing plunger assembly 38 to fully actuate, engaging movable contact 42 with fixed contacts 44 and 46. Then, pull-in coil 34 is shorted and cranking motor 22 turns, as before. As cranking motor 22 turns, the compressed mesh spring 49 forces pinion gear 28 into mesh with ring gear 32.

Timing diagrams showing the events which take place during cranking in a system using conventional starter motor assembly 20 is shown in FIG. 8. At time $t_0$, ignition switch 50 is closed by the operator of the vehicle. The current of starter solenoid 24 includes current drawn by both pull-in coil 34 and hold-in coil 36. At time $t_1$, movable contact 42 couples fixed contacts 44 and 46. This shorts pull-in coil 34, leaving only the current of hold-in coil 36 being drawn by solenoid 24. Also at time $t_1$, current is provided to cranking motor 22 via movable contact 42's coupling with fixed contacts 44 and 46. This current starts at a relatively high level and decreases to a fairly steady level as cranking motor 22 gets up to speed. Finally, at time $t_2$, ignition switch 50 has been turned off, either due to the engine having been successfully started or due to the operator of the vehicle ending the cranking event for another reason. After ignition switch 50 has been turned off, return spring 52 (FIG. 6) forces plunger assembly 38 back to the right, disengaging drive assembly 26 from ring gear 32.

A concern with the conventional cranking system illustrated in FIGS. 6–8 occurs in the aforementioned case in which pinion gear 28 interferes with ring gear 32 while solenoid 24 is actuating. In that event, mesh spring 49 does allow solenoid 24 to complete its actuation. However, when the actuation is complete, energizing cranking motor 22 and shorting pull-in coil 34, hold-in coil 36 is left alone to supervise the meshing of pinion gear 28 with ring gear 32. This can cause a less-than-robust final pull-in, causing milling of pinion gear 28 and ring gear 32. Also, relying on only hold-in coil 36 for the final pull-in makes the pull-in event more susceptible to variances in battery voltage and temperature.

Further, in the conventional cranking system of FIGS. 6–8, starter motor assembly 20 is a relatively large package. Also, by necessity, starter motor assembly 20 is usually packaged in an unfriendly environment (i.e., low in the engine compartment), where it can be exposed to dirt, water splash, road salt and high temperatures. The reliability of an electrical component such as solenoid 24, especially the reliability of contacts 42, 44 and 46, can be adversely affected by such an unfriendly environment.

A system which can overcome the several concerns detailed above with respect to a conventional cranking system can provide considerable performance and durability advantages over the conventional cranking system.

SUMMARY OF THE INVENTION

The present invention provides a method for controlling a cranking system of a motor vehicle. The method comprises from a time $t_0$ to a time $t_2$, providing a first current to an electrical coil of a solenoid to cause the solenoid to actuate, the actuation moving a cranking motor drive mechanism toward engagement with the engine. The method also includes: beginning at time $t_2$, providing a second current, greater than zero but less than the first current, to the electrical coil. Additionally, the method comprises: beginning at a time $t_1$, providing a current to the cranking motor, wherein time $t_1$ is before or concurrent with time $t_2$ and a predetermined amount of time after $t_0$.

The present invention also provides a cranking system for a motor vehicle engine. The system comprises an electrical power source, a cranking motor and a drive mechanism coupled to the cranking motor for rotation therewith and adapted for movement into engagement with the engine. In addition, the system comprises a solenoid mechanically coupled to the drive mechanism such that actuation of the solenoid moves the drive mechanism toward engagement with the engine, the solenoid further comprising an electrical coil which controls actuation of the solenoid. Further, the system includes contactor means coupled to the electrical power source and to the cranking motor for switchably coupling the cranking motor to the electrical power source. Also, the system comprises control circuitry adapted for independent electrical control of the solenoid and the contactor means.

Cranking systems designed in accordance with the present invention can exhibit improved performance and improved durability over alternative cranking system designs.

BRIEF DESCRIPTION OF THE DRAWINGS

FIG. 7 is an electrical schematic of a cranking system which employs prior-art starter motor assembly 20 of FIG. 6.

FIG. 8 is a timing diagram illustrating events occurring during the cranking of a motor vehicle using the prior-art cranking system of FIG. 7.

DETAILED DESCRIPTION OF THE PREFERRED EMBODIMENT

Figure 1:
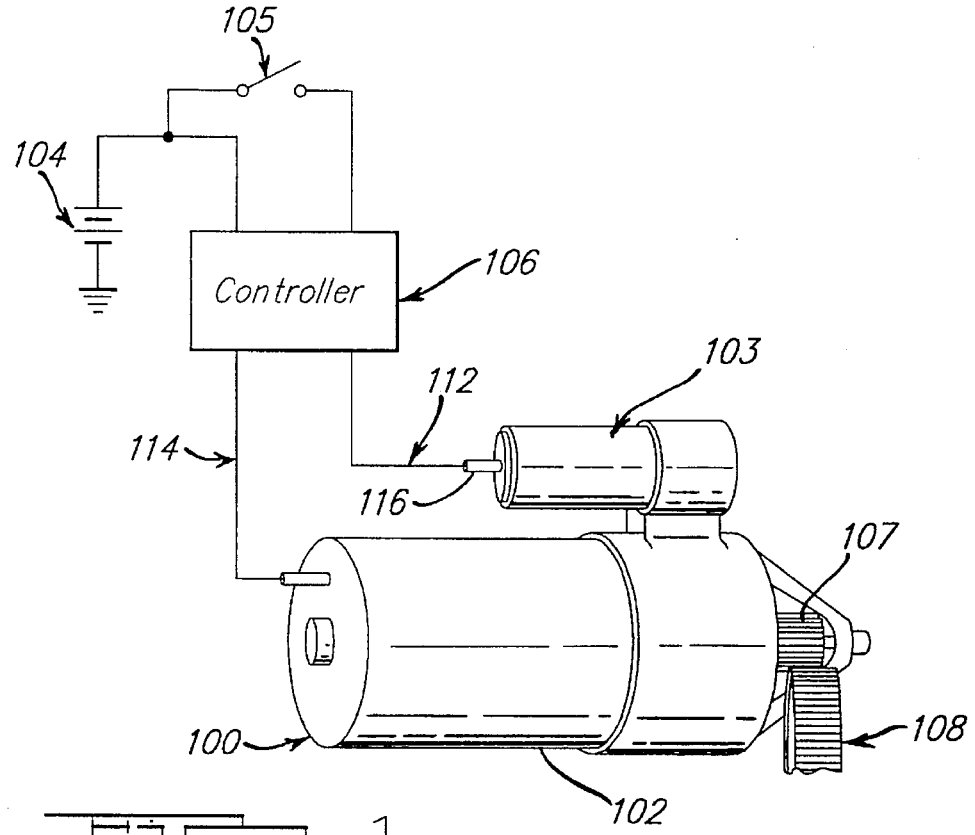
FIG. 1 is a diagram of a cranking system according to one embodiment of the present invention.

Referring to FIG. 1, a cranking system for a motor vehicle engine according to one embodiment of the present invention will be described. The system includes a starter motor assembly 100. Starter motor assembly 100 includes a cranking motor 102 and a starter solenoid 103. The system also includes battery 104, ignition switch 105 and electronic controller 106.

Figure 6:
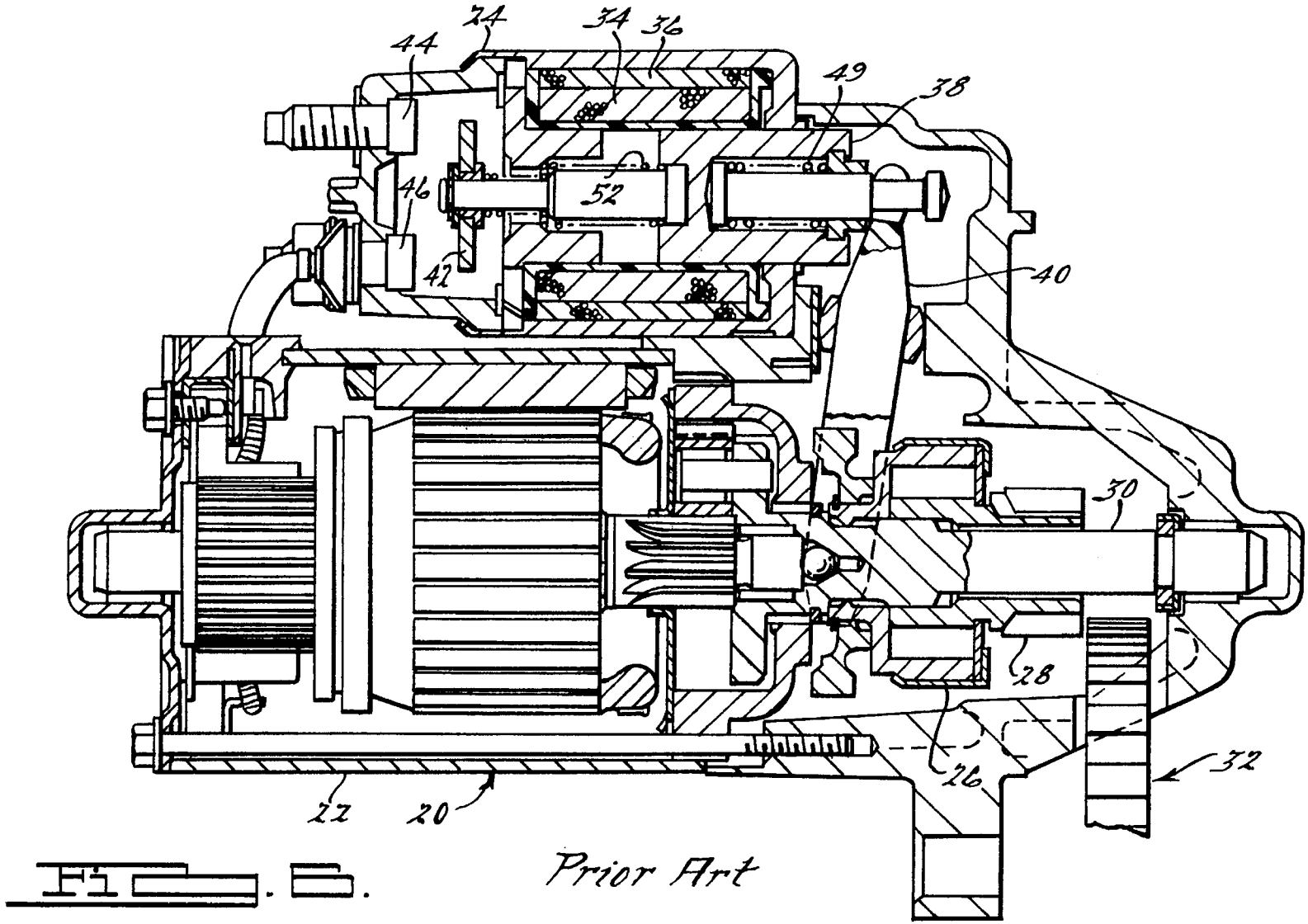
Prior Art FIG. 6
FIG. 6 is a cross-sectional side view of a prior-art starter motor assembly 20.
Figure 2:
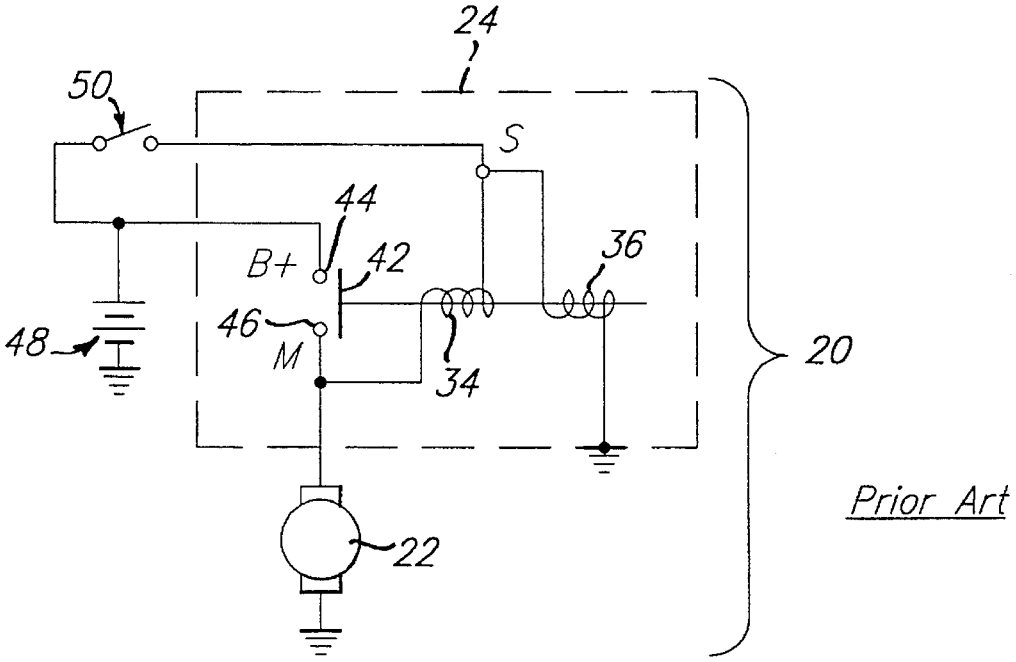

Cranking motor 102 is of the same design as cranking motor 22 (FIG. 6) and will therefore not be described in detail here. Cranking motor 102 includes a drive mechanism including pinion gear 107. The drive mechanism is translatably mounted for meshing with ring gear 108 of the engine.

Figure 2:
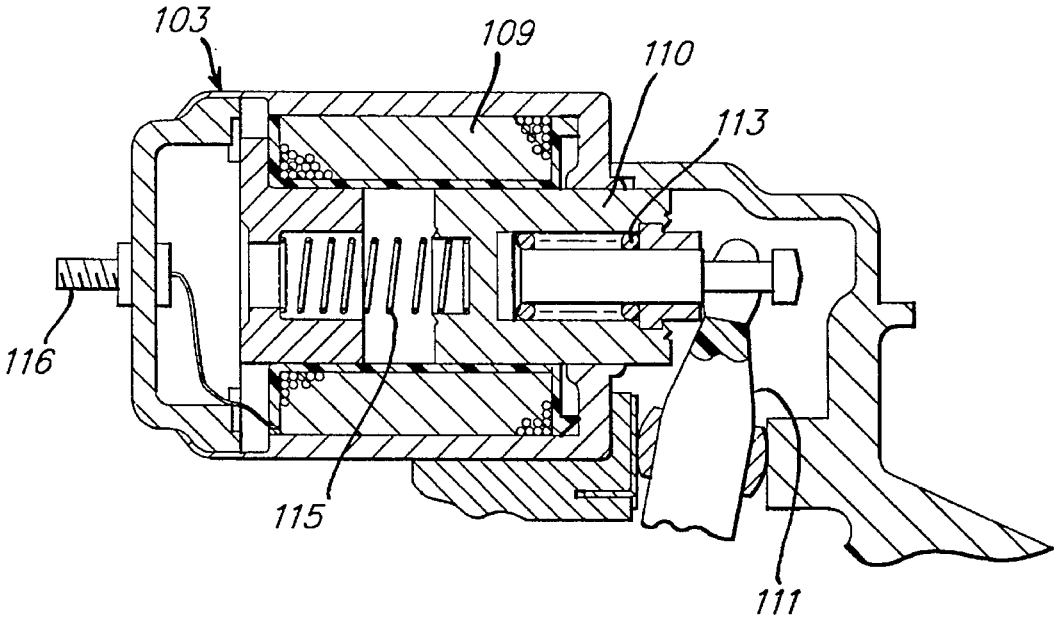
FIG. 2 is a cross-sectional side view of one embodiment of a starter solenoid 103 adapted for use in the cranking system of FIG. 1.
Figure 2:
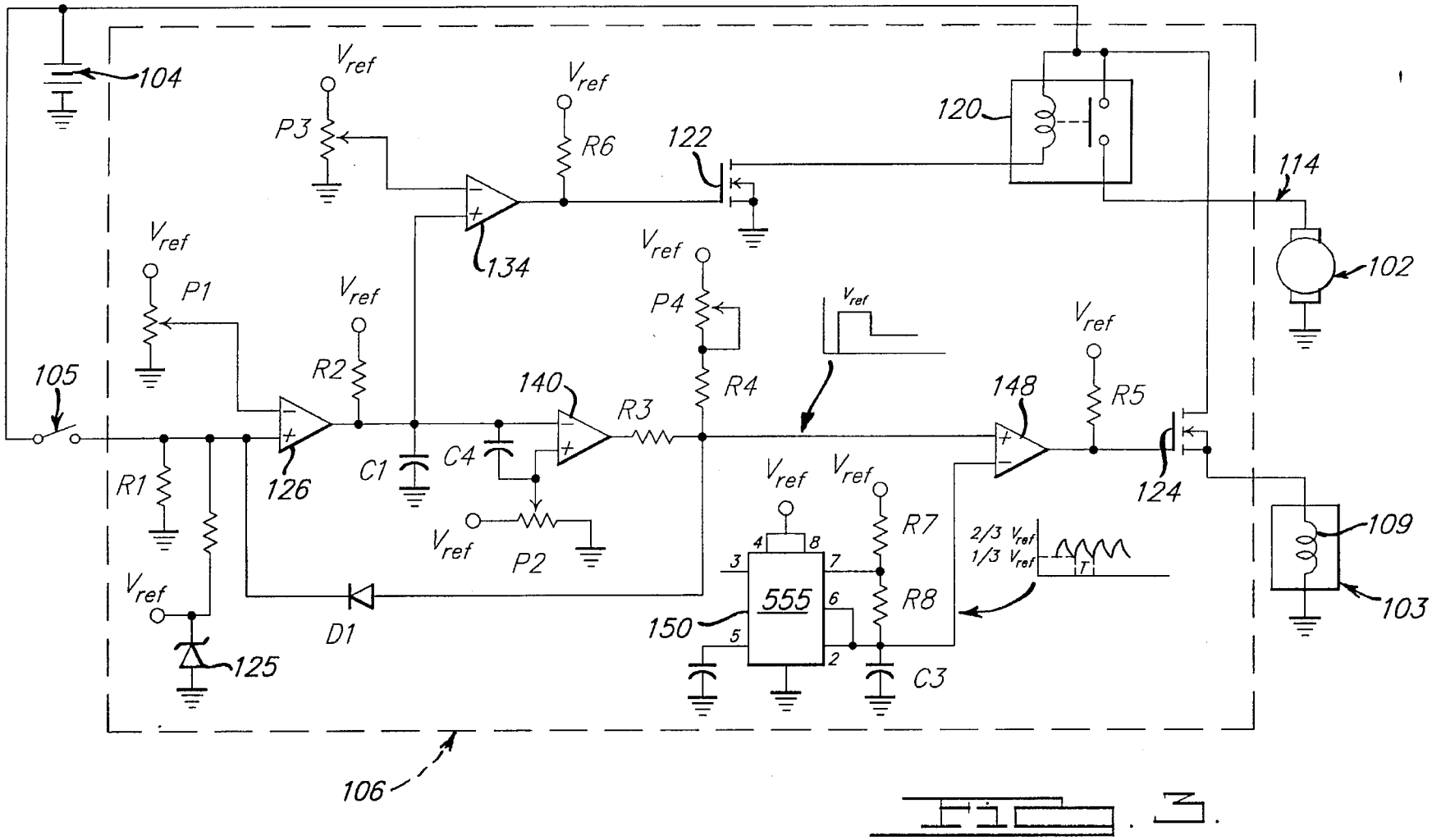

Referring now additionally to FIG. 2, starter solenoid 103 preferably has only a single coil 109, versus the two-coil design (pull-in and hold-in coils) of conventional starter solenoids. This coil 109 is electromechanically coupled to a plunger 110. The plunger is coupled in a conventional manner via lever 111 to the drive assembly of cranking motor 102. Pinion gear 107 can thus be translated into mesh with ring gear 108 when starter solenoid 103 is actuated. Starter solenoid 103 also contains a mesh spring 113 and a return spring 115. Starter solenoid 103 contains no electrical contacts for providing battery power to cranking motor 102. Because the only electrical component within starter solenoid 103 is a single coil 109, FIG. 1 shows that only a single circuit 112 couples controller 106 and starter solenoid 103. Circuit 112 is coupled to terminal 116 of solenoid 103, which is in turn coupled to coil 109. Terminal 116 can be, among other configurations, a spade terminal or a threaded stud. Termination of the wire of coil 109 to terminal 116 can be according to any number of methods known in the art of solenoid design. Controller 106 controls current through coil 109, as will be described below. Controller 106 also controls battery power to cranking motor 102 via circuit 114, as will also be described below.

Controller 106 will now be described with additional reference to FIG. 3. Controller 106 includes a contactor or relay 120 for supplying current to cranking motor 102. Transistor 122 controls contactor 120. Further, a transistor 124 controls current to the coil of starter solenoid 103. The remaining components in controller 106 control transistors 122 and 124, as will now be described.

Ignition switch 105 is coupled to zener diode 125, which supplies a regulated voltage $V_{reg}$. $V_{reg}$ is preferably about six to nine volts. Alternatively, $V_{reg}$ can be generated by a voltage regulator integrated circuit.

Ignition switch 105 is also coupled to the noninverting input of an open-collector comparator 126. The wiper of a potentiometer P1 is coupled to the inverting input of comparator 126. Potentiometer P1 is preferably set such that a voltage of five to six volts is applied to the inverting input of comparator 126. A pull-up resistor R2 is coupled to the output of comparator 126. Also coupled to the output of comparator 126 is a capacitor C1, coupled to ground. The output of comparator 126 is further coupled to the noninverting input of open-collector comparator 134. Coupled to the inverting input of comparator 134 is the wiper of potentiometer P3. The output of comparator 134 is coupled to pull-up resistor R6 and to the gate of transistor 122.

The output of comparator 126 is further coupled to the inverting input of open -collector comparator 140. The noninverting input of comparator 140 is coupled to the wiper of potentiometer P2. The output of comparator 140 is coupled via resistor R3 to the series combination of potentiometer P4 and resistor R4, pulled up to $V_{reg}$. Resistor R3 is also coupled to the noninverting input of open collector comparator 148. The inverting input of comparator 148 is coupled to the output of a timing circuit containing a 555-type timer integrated circuit 150, resistors R7 and R8 and capacitor C3. As shown in FIG. 3, that output provides a pseudo-triangle wave signal at the inverting input of comparator 148. The output of comparator 148 is pulled up to $V_{reg}$ via pull-up resistor R5 and is coupled to the gate of transistor 124.

The pseudo-triangle wave at the inverting input of comparator 148 will now briefly be discussed. The period of that signal will be:

$$T=0.7*(R_7+2\ R_s)*C_3.$$

In one embodiment of the present invention, $R_7$ and $R_8$ were chosen to be 2.4 kΩ and $C_3$ was chosen to be 0.01 μF. With that selection of components, the period of the pseudo-triangle wave is 50 microseconds (for a frequency of 20 kilohertz). Further, with that selection of components, the pseudo-triangle wave oscillates between ⅓ $V_{reg}$ and ⅔ $V_{reg}$.

The operation of controller 106 as it controls current to cranking motor 102 and starter solenoid 103 will now be described. First, the control of current to cranking motor 102 will be discussed. When ignition switch 105 is closed, the noninverting input of comparator 126 goes to approximately battery voltage (nominally 12 volts). Because the inverting input of comparator 126 is at five to six volts, the output of comparator 126 goes "open collector". Thus, capacitor C1 charges via pull-up resistor R2. When capacitor C1 is charged to a larger voltage than the voltage applied at the inverting input of comparator 134 by potentiometer P3, the output of comparator 134 goes "open collector". Thus, $V_{reg}$ is applied via pull-up resistor R6 to the gate of transistor 122, turning on transistor 122. This actuates contactor 120, providing current to cranking motor 102. It can be seen that the delay between closing of ignition switch 105 and the energizing of cranking motor 102 is a function of the voltage to which potentiometer P3 is adjusted. The lower the voltage, the faster the charging of capacitor C1 can cause comparator 134 to turn on transistor 122.

When ignition switch 105 is opened, the output of comparator 126 goes low. Thus, the noninverting input of comparator 134 is low, causing the output of comparator 134 to go low. Transistor 122 and contactor 120 are thus turned off.

The operation of controller 106 as it relates to the control of solenoid 103 will now be discussed. Upon the closing of ignition switch 105, capacitor C1 has not yet begun to charge and is therefore at zero volts. Thus, the noninverting input of comparator 140 is higher in voltage than the inverting input. The output of comparator 140 is therefore "open collector," thus causing $V_{reg}$ to be applied to the noninverting input of comparator 148 via potentiometer P4 and resistor R4. Because the pseudo-triangle wave at the inverting input of comparator 148 never has a voltage above ⅔ $V_{reg}$, the $V_{reg}$ at the noninverting input will cause the output of comparator 148 to go continuously "open collector". Thus, $V_{reg}$ is applied to the gate of transistor 124 via pull-up resistor R5. Therefore, transistor 124 is full-on, supplying maximum current to coil 109 of solenoid 103.

However, after capacitor C1 has charged sufficiently that the inverting input of comparator 140 is at a higher voltage than the noninverting input, the output of comparator 140 will go low (approximately zero volts). Thus, the voltage at the noninverting input of comparator 148 will be due to a voltage divider created by potentiometer P4, resistor R4 and resistor R3. This voltage can be represented by the equation:

$$V=\frac{V_{reg}*R_3}{R_3+R_4+P_4}.$$

This voltage is selected to be between ⅓ $V_{reg}$ and ⅔ $V_{reg}$, so the voltage applied to the gate of transistor 124 will now be modulated by the pseudo-triangle wave at the inverting input of comparator 148. Thus, the voltage provided by transistor 124 to coil 109 of solenoid 103 will be modulated. The voltage will therefore have a lower average value than the constant voltage provided to coil 109 when transistor 124 was full-on during the time period immediately after ignition switch 105 was closed.

When ignition switch 105 is opened, the voltage at the noninverting input of comparator 148 goes very low, due to current conducted through diode D1 and resistor R1 to ground. Since the inverting input of comparator 148 is oscillating between ⅓ $V_{reg}$ and ⅔ $V_{reg}$, the output of comparator 148 will now be constantly low, turning off transistor 124 and cutting off current to coil 109.

Figure 4:
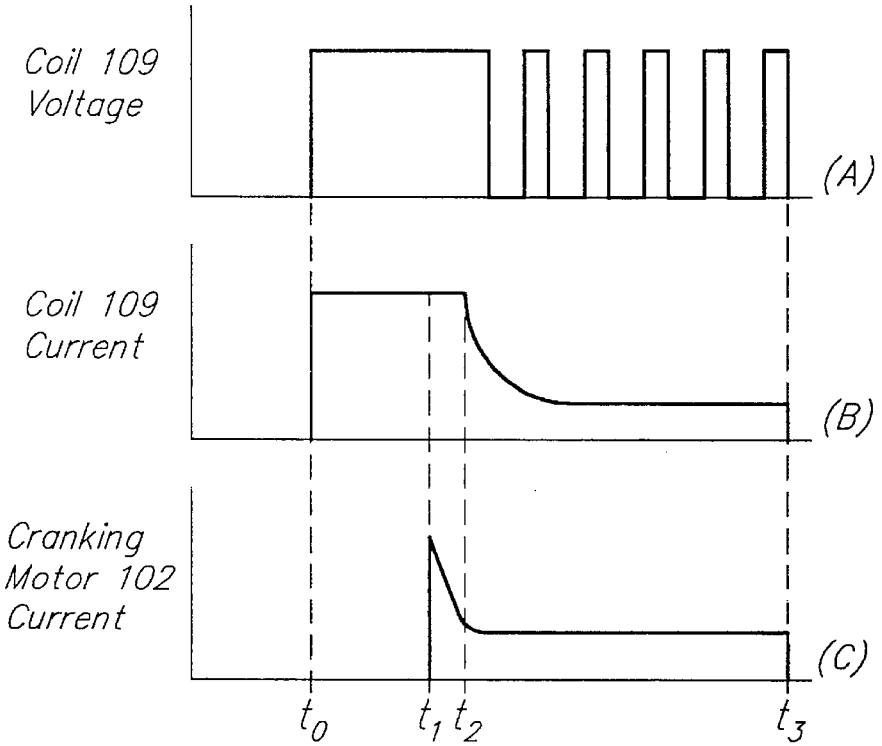
FIG. 4 shows timing diagrams illustrating various events occurring during the cranking of a motor vehicle using the cranking system of FIG. 1.
Figure 3:
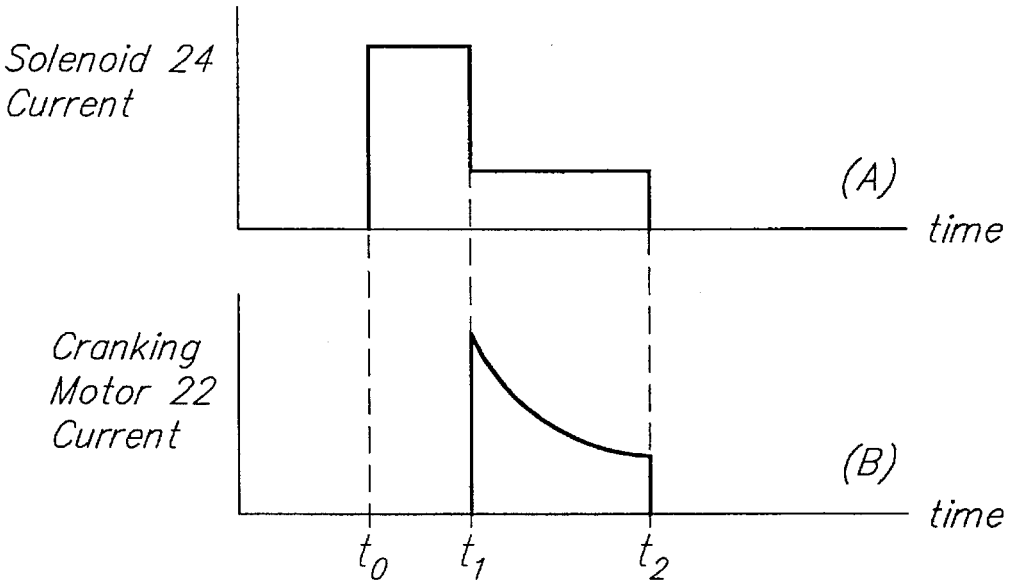
Prior Art FIG. 3.
FIG. 3 is an electrical schematic of one embodiment of controller 106 of FIG. 1.

Timing diagrams of relevant signals generated within the system of FIGS. 1, 2 and 3 are illustrated with additional reference to curves (A), (B) and (C) of FIG. 4. At time $t_0$, ignition switch 105 is closed. The voltage provided to coil 109 by transistor 124 goes to about +12 volts (curve (A)). The current through coil 109 goes to its maximum design value (curve (B)), in order to pull in pinion gear 107. At time $t_1$, current is provided via contactor 120 to cranking motor 102 (curve (C)). The delay between time $t_0$ and time $t_1$ (selected via potentiometer P3) is selected to be long enough for solenoid 103 to fully actuate. Recall that if pinion gear 107 and ring gear 108 do not interfere with one another, solenoid 103 will fully actuate with pinion gear 107 and ring gear 108 fully meshed. If pinion gear 107 and ring gear 108 interfere with one another, solenoid 103 will fully actuate by compressing the mesh spring within solenoid 103.

The current in coil 109 is held until time $t_2$. Note that time $t_2$ is no earlier than time $t_1$, and preferably a short time after $t_1$. Thus, full pull-in current is assured to be held through the beginning of current supply to cranking motor 102. A robust pull-in event is thus provided, minimizing milling of pinion gear 107 and ring gear 108. Further, susceptibility of the pull-in event to variations in voltage and temperature are greatly reduced. At time $t_2$, the voltage at coil 109 begins to have a switched signature. This voltage has a lower average value than the 12 volts provided to coil 109 prior to $t_2$. Thus, the current through coil 109 is reduced. This current is selected to be the hold-in current required to assure that pinion gear 107 remains meshed with ring gear 108 through the entire starting event. Finally, at time $t_3$, the operator of the vehicle has opened ignition switch 105. Voltage is no longer applied to coil 109, so the current through coil 109 also goes to zero. Further, current is no longer supplied to cranking motor 102.

The reduced current through coil 109 is provided by a switched voltage signal to minimize power dissipation and heat generation in transistor 124. Linear control of the voltage to solenoid coil 109 can be used as well.

Further, potentiometers P1–P3 can each be replaced by a fixed voltage divider which divides $V_{reg}$ down to a fixed (non-adjustable) voltage. Also, potentiometer P4 can be replaced by a fixed (non-adjustable) resistance.

As illustrated in FIG. 1, controller 106 is not part of starter motor assembly 100. Thus, there is considerable flexibility in choosing a mounting location for controller 106. Preferably, controller 106 is mounted remotely from starter motor assembly 100, in a more "friendly" environment. An example of such an environment is high in the engine compartment and away from the engine. Such a location is more friendly both for the electronics within controller 106 and for the contacts which couple battery 104 to cranking motor 102.

With starter solenoid 103 having only a single electrical coil and having no electrical contacts, starter solenoid 103 becomes smaller in size. Thus, starter motor assembly 100 becomes easier to package when compared to conventional starter motor assemblies. This is advantageous, because space in the normal mounting location of a starter motor is typically very dear.

An additional significant advantage of this system is that starter motor assembly 100 has no continuously "hot" (i.e., unswitched) connection to vehicle battery 104. In conventional engine cranking systems, the starter solenoid has such a continuously "hot" connection. In servicing the engine of a vehicle having such a conventional system, great care is required to avoid inadvertently shorting the continuously "hot" connection to ground with, for example, the handle of a wrench. Electrical insulating means such as a plastic cap are sometimes even employed to protect the "hot" connection from inadvertent shorting to ground. By contrast, in the present system, the only continuously "hot" connection is at controller 106, which is preferably located away from the engine. The only connections from vehicle battery 104 to starter motor assembly 100 are switched by controller 106.

It should be noted that in this embodiment of the present invention, solenoid 103 and contactor 120 are controlled independently. "Independently," as used herein, means that the actuation of contactor 120 does not in itself provide any control over the current supplied to solenoid 103. (In contrast, recall that in the conventional cranking system of FIGS. 6–8, actuation of movable contact 42 to couple fixed contacts 44 and 46 shorts out pull-in coil 34.) "Independently" also means that the actuation of solenoid 103 does not in itself provide any control over the actuation of contactor 120. (In contrast, recall that in the conventional cranking system of FIGS. 6–8, actuation of pull-in coil 34 and hold-in coil 36 causes movable contact 42 to move into engagement with fixed contacts 44 and 46.)

In a variation on the cranking system design disclosed herein, starter solenoid 103 can have its mesh spring 113 removed. In the event of interference between pinion gear 107 and ring gear 108 during the pull-in event, controller 106 will continue to hold the pull-in current. This will hold pinion gear 107 against ring gear 108, with solenoid 103 not fully actuated, but as fully actuated as possible (given the interference between pinion gear 107 and ring gear 108). The pull-in current will continue to be held until after controller 106 provides current to cranking motor 102. When cranking motor 102 begins to turn, the pull-in current provided to coil 109 of starter solenoid 103 will cause pinion gear 107 to mesh with ring gear 108. A design of starter solenoid 103 which eliminates mesh spring 113 can reduce the cost of starter solenoid 103.

If a mesh spring 113 is provided, and if there is interference between pinion gear 107 and ring gear 108, solenoid 103 will also actuate as fully as possible given the interference. However, this actuation will be greater than the case in which no mesh spring 113 is provided (and could be full actuation of solenoid 103).

Figure 5:
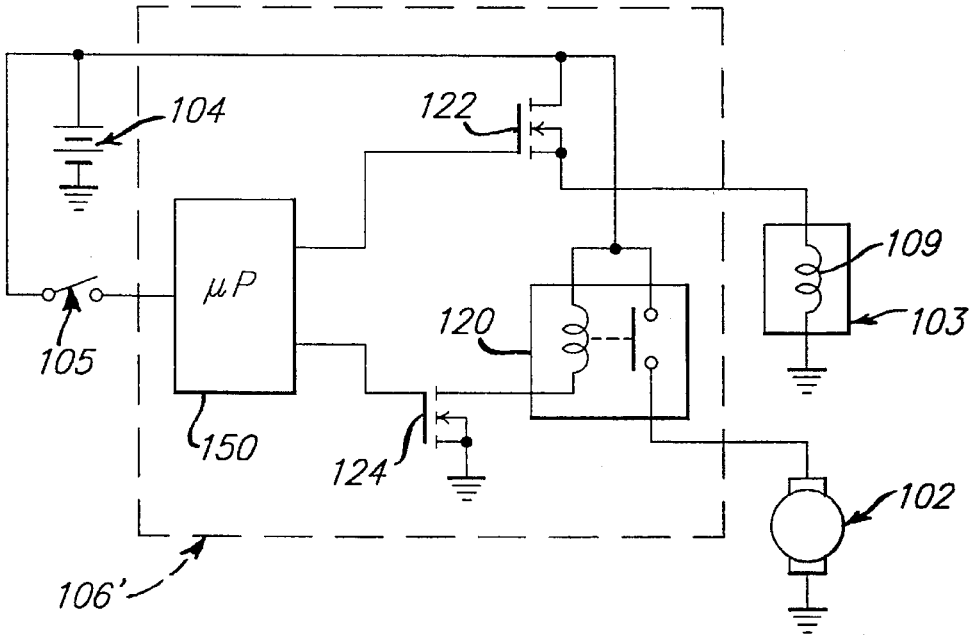
FIG. 5 is an electrical schematic of a second embodiment of controller 106 of FIG. 1.

An alternative design for controller 106 is shown in FIG. 5. Here, controller 106' includes a microprocessor 150. Microprocessor 150 has as an input the state of ignition switch 105. Under software control, microprocessor 150 controls transistors 122 and 124 to control the currents to cranking motor 102 and solenoid coil 109. The currents to cranking motor 102 and solenoid coil 109 are controlled according to the timing diagrams shown in FIG. 4. Those timing diagrams were discussed earlier in this disclosure.

Various other modifications and variations will no doubt occur to those skilled in the arts to which this invention pertains. Such variations which generally rely on the teachings through which this disclosure has advanced the art are properly considered within the scope of this invention. This disclosure should thus be considered illustrative, not limiting; the scope of the invention is instead defined by the following claims.

What is claimed is:

1. A method for controlling a cranking system for a motor vehicle engine, said method comprising:

(a) from a time $t_0$ to a time $t_2$, providing a first current to an electrical coil of a solenoid to cause said solenoid to actuate, the actuation moving a cranking motor drive mechanism toward engagement with said engine;

(b) beginning at time $t_2$, providing a second current, greater than zero but less than said first current, to said electrical coil;

(c) beginning at a time $t_1$, providing a current to said cranking motor, wherein time $t_1$ is a predetermined amount of time after $t_0$;

wherein $t_1$ is selected to be a time at which said solenoid is fully actuated; and wherein $t_1$ is before $t_2$.

2. A method for controlling a cranking system for a motor vehicle engine, said method comprising:

(a) from a time $t_0$ to a time $t_2$, providing a first current to an electrical coil of a solenoid to cause said solenoid to actuate, the actuation moving a cranking motor drive mechanism toward engagement with said engine;

(b) beginning at time $t_2$; providing a second current, greater than zero but less than said first current, to said electrical coil;

(c) beginning at a time $t_1$, providing a current to said cranking motor, wherein time $t_1$ is before or concurrent with time $t_2$ and a predetermined amount of time after $t_0$;

wherein said drive mechanism includes a first gear and said engine includes a second gear, and wherein $t_1$ is selected to be a time at which:

(a) if said first gear is not in interference with said second gear, said first gear and said second gear are fully meshed;

(b) if said first gear is in interference with said second gear, said solenoid is as fully actuated as possible in view of the interference of said first gear and said second gear.

3. A method as recited in claim 2, wherein said second current is sufficient to hold said first gear and said second gear in meshing engagement.

4. A method as recited in claim 3, wherein time $t_1$ is before time $t_2$.

5. A method as recited in claim 4, wherein said second current is generated by applying a switched voltage to said solenoid coil.

6. A method for controlling a cranking system for a motor vehicle engine, said method comprising:

(a) from a time $t_0$ to a time $t_2$, providing a first current to an electrical coil of a solenoid to cause said solenoid to actuate, the actuation moving a cranking motor drive mechanism toward engagement with said engine;

(b) beginning at time $t_2$, providing a second current, greater than zero but less than said first current, to said electrical coil;

(c) beginning at a time $t_1$, providing a current to said cranking motor, wherein time $t_1$ is a predetermined amount of time after $t_0$;

wherein time $t_1$ is before time $t_2$.

7. A method as recited in claim 6, wherein said drive mechanism includes a first gear and said engine includes a second gear, and wherein $t_1$ is selected to be a time at which:

(a) if said first gear is not in interference with said second gear, said first gear and said second gear are fully meshed;

(b) if said first gear is in interference with said second gear, said solenoid is as fully actuated as possible in view of interference of said first gear and said second gear.

8. A method as recited in claim 7, wherein said second current is sufficient to hold said first gear and said second gear in meshing engagement.

9. A cranking system for a motor vehicle engine, said system comprising:

an electrical power source;

a cranking motor;

a drive mechanism coupled to said cranking motor for rotation therewith and adapted for movement into engagement with said engine;

a solenoid mechanically coupled to said drive mechanism such that actuation of said solenoid moves said drive mechanism toward engagement with said engine, said solenoid further comprising an electrical coil which controls actuation of the solenoid;

contactor means coupled to said electrical power source and to said cranking motor for switchably coupling said cranking motor to said electrical power source; and control circuitry adapted for independent electrical control of said solenoid and said contactor means.

10. A system as recited in claim 9, wherein said contactor means is located remotely from said cranking motor.

11. A system as recited in claim 10, wherein said control circuitry is located remotely from said cranking motor.

12. A system as recited in claim 9, wherein said control circuitry includes means for applying a first current to said electrical coil for a predetermined time and a second current thereafter, said second current less than said first current.

13. A system as recited in claim 12, wherein said control circuitry includes means for closing said contactor means a predetermined time after applying said first current to said electrical coil and before or concurrently with the application of said second current.

14. A system as recited in claim 12, wherein said control circuitry includes means for closing said contactor means a predetermined time after applying said first current to said electrical coil and before the application of said second current.

15. A cranking system for a motor vehicle comprising:

an electrical power source;

a cranking motor;

a drive mechanism coupled to said cranking motor for rotation therewith and adapted for movement into engagement with said engine;

a solenoid coupled to said drive mechanism such that actuation of said solenoid moves said drive mechanism into engagement with said engine, said solenoid further comprising an electrical coil which controls actuation of the solenoid:

contactor means coupled to said electrical power source and to said cranking motor for switchably coupling said cranking motor to said electrical power source; and control circuitry adapted for independent electrical control of said solenoid and said contactor means;

wherein said control circuitry is located remotely from said cranking motor.

16. A system as recited in claim 15, wherein said control circuitry includes means for applying a first current to said electrical coil for a predetermined time and a second current thereafter, said second current less than said first current.

17. A system as recited in claim 16, wherein said control circuitry includes means for closing said contactor means a predetermined time after applying said first current to said electrical coil and before or concurrently with the application of said second current.

18. A system as recited in claim 16, wherein said control circuitry includes means for closing said contactor means a predetermined time after applying said first current to said electrical coil and before the application of said second current.

* * * * *